United States Patent [19]

Goodwin

[11] 4,030,724

[45] June 21, 1977

[54] HIGH OPERATOR EFFICIENCY DUPLICATING SYSTEM

[75] Inventor: Eber Lyle Goodwin, Arlington Heights, Ill.

[73] Assignee: Addressograph Multigraph Corporation, Cleveland, Ohio

[22] Filed: Aug. 14, 1975

[21] Appl. No.: 600,992

[52] U.S. Cl. ..... 271/64; 271/173; 271/184; 271/210

[51] Int. Cl.[2] ..... B65H 31/24; B65H 29/60; B65H 31/40

[58] Field of Search ..... 271/173, 225, 184, 64, 271/210; 270/58; 101/2, 232; 355/3 R; 312/266, 268; 108/22

[56] References Cited

UNITED STATES PATENTS

| | | | |
|---|---|---|---|
| 1,831,245 | 11/1931 | Hitchcock | 271/225 X |
| 2,629,592 | 2/1953 | Line | 271/210 |
| 3,076,647 | 2/1963 | Lowe et al. | 271/173 |
| 3,144,248 | 8/1964 | Fornell et al. | 270/58 |
| 3,371,926 | 3/1968 | Anderson et al. | 271/64 |
| 3,401,930 | 9/1968 | Bishop | 271/225 |
| 3,658,322 | 4/1972 | Martin | 271/184 |
| 3,744,790 | 7/1973 | Hoffman | 271/64 |

*Primary Examiner*—Johnny D. Cherry
*Assistant Examiner*—Bruce H. Stoner, Jr.
*Attorney, Agent, or Firm*—Russell L. Root

[57] ABSTRACT

In order to make utmost use of the time and effort of an operator, a duplication system has been devised in which first the duplicator equipment feeds the copy paper along a linear path while producing the copies, the path then turns, and the copy is fed by a direction changing means in a direction substantially normal to the original path into a sheet distributor which has its unloading apertures arranged so as to be convenient to an operator standing at an operator station beside the discharge end of the duplicator device at the operation side thereof. The distributor is of a type such that the unloading openings are exposed to operator access at or slightly above waist level, and is preferably a rotary distributor capable of moving the filled pockets to a fixed unloading position. A work surface extends from a point adjacent the sheet distributor to a point near the input end of the duplicator, and may include a power sheet jogger at its end near the distributor, and operator desk means at its other end for receipt and organization of incoming work. In a preferred form, the direction changing means and the distributor are arranged to be of a width more than double the usual sheet dimension so as to allow use of alternate halves thereof to permit, for example, unloading one-half of the distributor while the other half is being loaded by a subsequent job.

7 Claims, 5 Drawing Figures

HIGH OPERATOR EFFICIENCY DUPLICATING SYSTEM

BACKGROUND OF THE INVENTION

Conventional high production duplicators heretofore in use were generally lithographic duplicators and are usually of substantial length; e.g., about 5 to 8 feet. To this is usually added a copy collator or distributor which then constitutes an assembly about nine to thirteen feet long between the input end and the discharge end.

Operating equipment of this nature, however automated, requires a great deal of walking and other activity as the operator moves from the input end where masters and paper are inserted to the control station and to the discharge end, and back and forth between these latter two, and thence back and forth to a work table as copies are unloaded from the collator or distributor.

Because of the activity required it is not only tiring for the operator, but fails to bring forth from such a duplicator, especially when highly automated, the production of which it is inherently capable.

SUMMARY OF THE INVENTION

The present invention effects an arrangement of the parts into a duplicating system such that a sequence of printing jobs can be run by a single operator without most of the currently necessary back and forth trips, whereby job preparation, duplication, collation or distribution, removal of copies from the distributor, an auxiliary treatments such as jogging and stapling if required, may be performed by a single operator in such manner as to keep the equipment operating at or near full capacity.

This result is achieved first by arranging the operators's travel path in a much more compact pattern by disposing the distributor or collator at a location such that the direction of input is at a substantial angle to the paper path of the duplicator. This angle may be 90°, plus or minus about 20°, and is hereinafter referred to as substantially normal. Secondly, controls are provided near the distributor or collator which control not only its functions but control remotely the functions of the duplicator so that copy count and the like may be set without moving back to the duplicator itself. Thirdly, the distributor or collator is of a special type such that the pocket openings are at a level convenient to the hands of a standing operator to facilitate and expedite unloading, and in the preferred form the distributor is of the rotary drum type which is capable of bringing each pocket to a specific location for unloading. Fourthly, an elongate work surface is provided with one end generally adjacent the side of the distributor which faces towards the duplicator, and extends back towards the input of end of the duplicator in general parallelism with the duplicator. An initial portion of this work surface provides power jogging means for treating the sheets as they come from the distributor, and provides table top room for stapling and arranging the finished product. The remote end serves as a desk for the operator and a receiving surface for incoming work arranging in close proximity to the input end of the duplicator.

Additional alternate path features, described in detail hereinafter, provide for concurrent operation of separate portions of the system on more than one work assignment.

While the present invention is described mainly in terms of a lithographic duplicator, it will be understood that its principles are applicable to any type of duplicator, such, for example, as high-speed electrophotographic equipment, and when the terms "duplicator'-'and "duplicating system" are used hereinafter, all types of reprographic equipment are embraced.

DESCRIPTION OF THE PREFERRED EMBODIMENT

Figure 1:
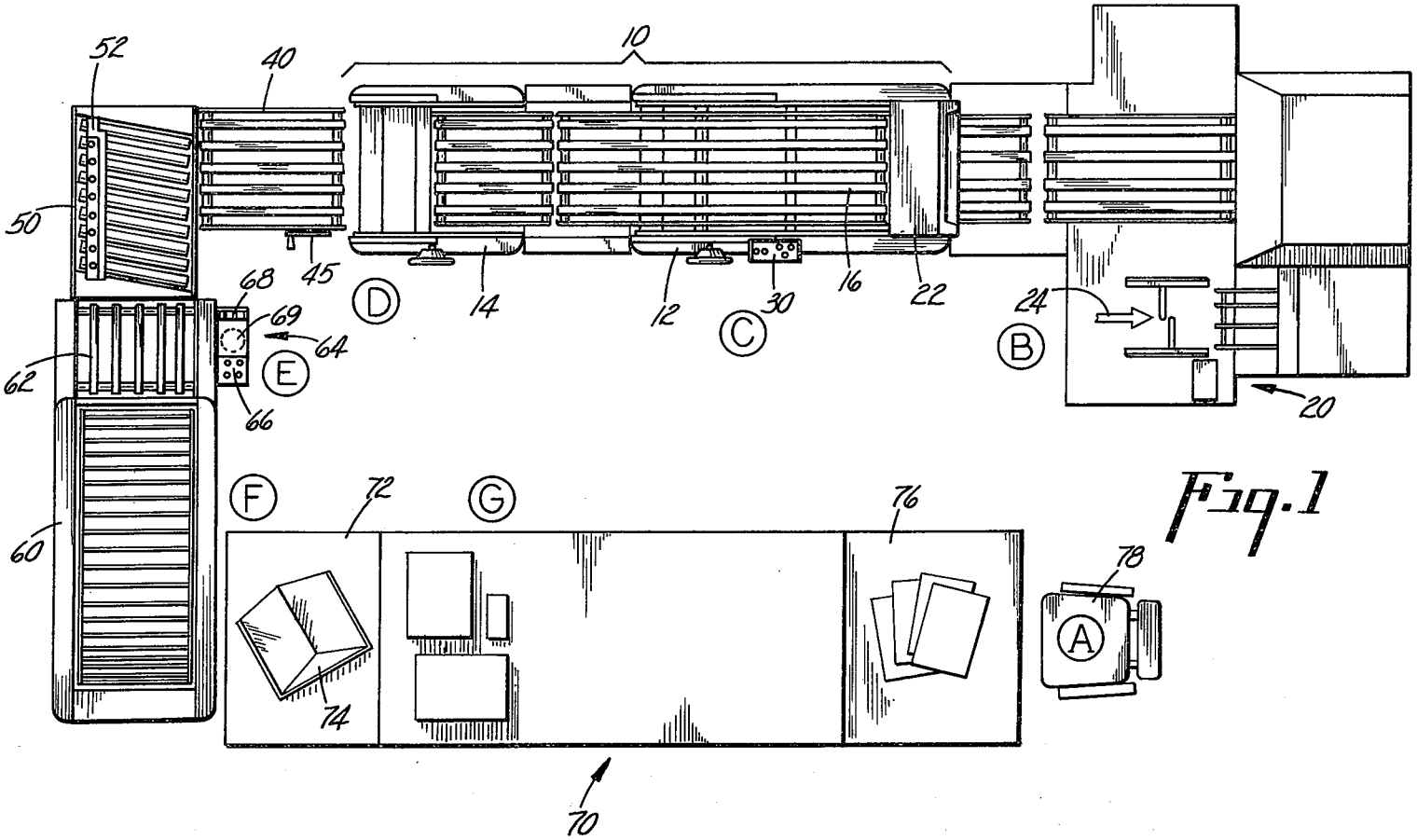
FIG. 1 is a plan view of a duplicating system according to the present invention.

Referring to the drawing, there is shown a duplicating system according to the present invention, comprising a duplicator 10. In the particular form shown this consists of an Addressograph-Multigraph Model 2875 tandem lithographic duplicator for printing on both sides of a sheet of paper, and comprising a first print head 12, a second print head 14, and overhead conveyor means 16 for automatically conveying masters from a suitable insertion point to the two print heads at appropriate times.

Also in the form shown, the combination includes at the input end of the duplicator 10 a master 20 for preparing lithographic masters by a photoelectrostatic copying procedure, and a conversion unit 22 for treating the masters on line to give the appropriate hydrophilic/oleophilic properties to serve as lithographic printing elements. Original documents are inserted into the master maker as indicated by the arrow 24.

The equipment just described is disclosed in further detail in my co-pending U.S. patent application, Ser. No. 537,088 filed Dec. 20, 1974. It will be understood, of course, that this invention will find appropriate application with duplicators of different types, whether they are of the single print head or tandem type, and whether or not they rely on on-line or off-line master preparation facilities.

About midway of the duplicator length, on the operation side thereof, is a control panel 30 used by the operator for setting up the duplicator for the basic mode of operation suited to the type of work being done. This is usually a preliminary matter for a series of jobs and an operation which is only infrequently required.

Figure 2:
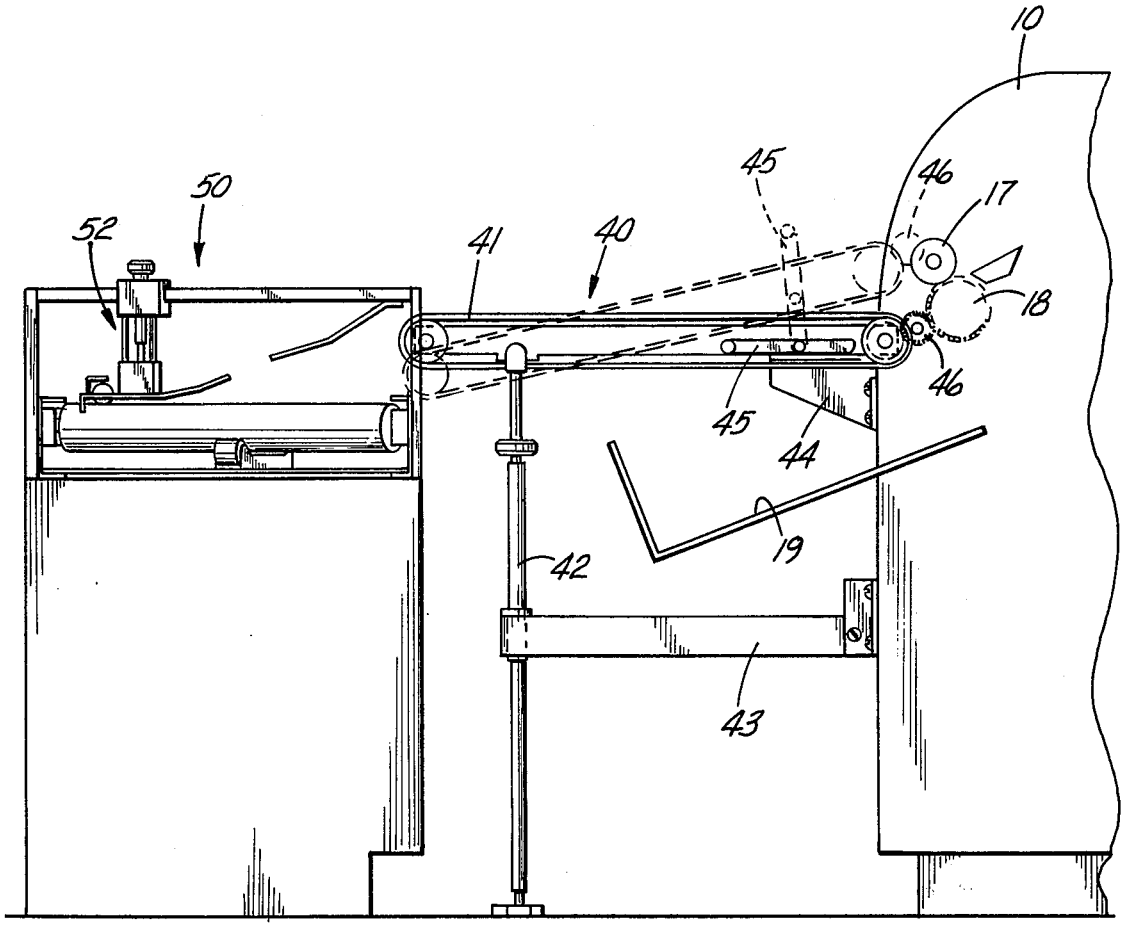
FIG. 2 is an elevation of a portion of the duplicator showing especially, in each of its two positions, the interface transport between the duplicator and the transverse conveyor.

At the discharge end of the duplicator 10 is an interface transport 40, shown in greater detail in FIG. 2, for carrying printed copy sheets to a direction changing mechanism in the form of a roller conveyor 50 designed to redirect the printed copy sheets into a path substantially normal to that along which they issue from the duplicator.

One specific form of direction changing mechanism is shown in detail in my copending application Ser. No. 601,008 filed Aug. 14, 1975.

The sheets are carried by the direction changing mechanism 50, including a sheet guide and aligning means 52, to the input conveyor 62 of a sheet distributing mechanism 60. In the preferred form shown this is a rotary drum collator and distributor with a sequence of pockets into which the sheets are fed in suitable sequence, with the pocket openings arranged for convenient hand access by a standing operator. This may be, say, between about average waist level an average shoulder level, which for convenience hereinafter will be identified as average trunk level.

It should be understood that various types of collators or distributors can be used, and that any one which makes the pockets readily accessible to the operator standing at the operation side of the device at trunk level will serve the purposes of this invention. A rotary collator is especially preferred because of its capability to move the pockets one by one, to a predetermined location so as to be especially convenient for unloading by the operator.

Since collating and sheet distributing are frequently carried out by the same equipment in different modes of operation, a device such as the device 60 will be hereinafter referred to as a "sheet distributor" or a "distributor" with the understanding that this embraces various types of mechanism capable of operating in any or all of the modes customary to such equipment.

The distributor mechanism normally is provided with a control panel 64 embodying controls for various purposes such as selecting the operating mode as between collating, distributing, merely collecting the duplicator output in a single pocket, etc. In the case of rotary distributors, there is a continuous rotary mode, a stepping mode, and a rocking mode. In addition controls may also be provided for selecting various patterns of sheet distribution on the basis of predesigned programs, either in totally programmed fashion, or including copy count selection for ascertaining the number of copies to be inserted into a few indeterminate pockets included in an otherwise predetermined program. Controls of this type are indicated diagrammatically at 66.

Also embodied in the control panel 64 are certain remote duplicator controls, particularly the start-stop controls 68 and the most selection controls 69 for a purpose which will presently appear.

Adjacent the distributor 60 and extending from the operation face thereof is a work surface 70. The end 72 thereof carries a power jogging mechanism 74 for aligning the sheets of each pocket as the operator withdraws them from a pocket of the distributor 60. The midsection 75 of the work surface is available for any other operations to be performed on the work product involving stapling, arranging, packaging, etc.

Finally the work surface includes a terminal element 76 which may include drawers and kneehole means to serve as a desk for an operator occupying the chair 78, for example. This provides a receiving station for incoming duplication work, very close to the input end of the duplicator, where the operator may inspect the work, log it in, sort it into categories, and in general prepare it to be accepted by the master maker 20 or the duplicator 10.

Turning to FIG. 2, there is shown the end of the duplicator mechanism 10 including feed out rollers 17 and 18. As is well-known, these rollers customarily feed the completed copy sheets into a receiver 19.

The interface transport 40, previously described in a general way, is also shown and includes a belt type conveyor 41 whose end remote from the duplicator is pivotally supported on an adjustable post 42 connected by a bracket 43 with the base of the duplicator. A bracket 44 attached to the duplicator forms a rest point for the near end of the conveyor 41 in one position, and a reaction plate for cooperation with a lifting lever 45 pivoted to the body of the conveyor. The conveyor 41 is driven by gearing 46 which meshes with suitable power-driven gearing on the duplicator when the conveyor is in lowered position.

As can be seen from FIG. 2, when the conveyor 41 is in its normal lowered or full line position, printed copy sheets will be carried to and deposited on the roller conveyor 50 where they will be redirected in a path substantially normal to the path of exit from the duplicator 10. If, however, the operator wishes to collect all the sheets in one place without using the distributor 60 to do so, he can merely turn the lever 45, raising the conveyor 41 to broken line position, whereupon the sheets will be directed into the receiver 19 in the well understood manner.

The equipment thus far described exhibits many of the features of novelty which will be explained at length in the statement of operation appended below. However, by making a somewhat minor change, the equipment is capable of greatly increased flexibility and production.

As seen in FIGS. 1 and 2, the direction changing mechanism 50 and the pockets of sheet distributor 60 are shown as being substantially of a width to receive easily the long dimension of sheets issuing lengthwise from the duplicator 10. The change above-mentioned includes (as shown in FIGS. 4 and 5) the provision of a direction changing device or roller conveyer 50', a conveyor 62' and a distributor 60' whose widths are designed to receive easily two sheet lengths.

Figure 4:
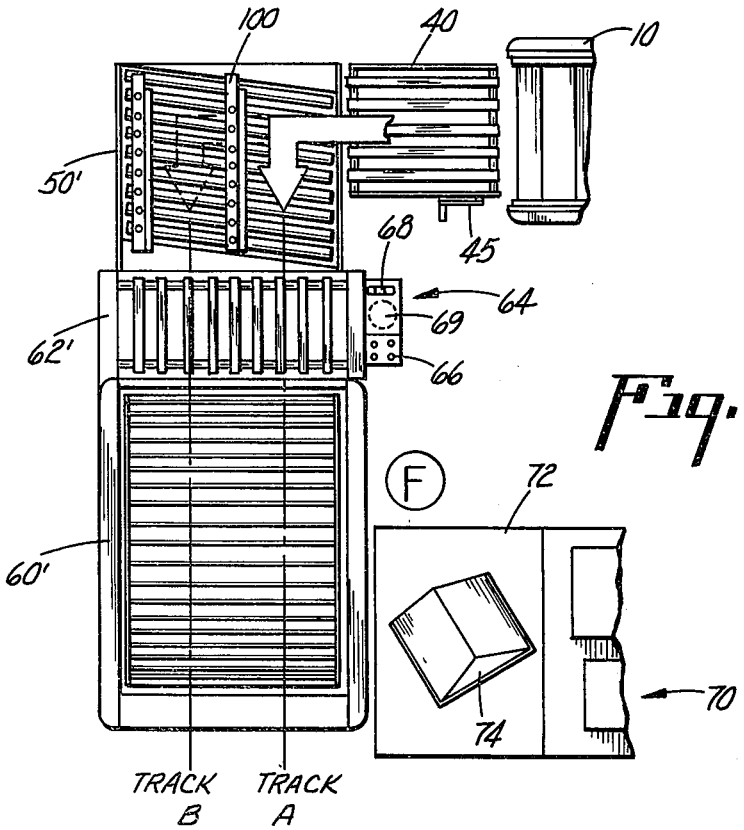
FIG. 4 shows in plan, similar to a portion of FIG. 1, an alternate form of direction changing mechanism and distributor.

An arrangement such as this is illustrated in plan in FIG. 4 wherein the sheets issuing from the duplicator are shown being directed by a first sheet guide and aligning means 100 along track A into the near side of the pockets of distributor 60'. By deactivating the sheet guide and aligning means 100 the sheets are allowed to pass thereunder and to come into contact with the sheet guide and aligning means 52 as they issue from the duplicator, thereby being introduced via track B to the other or remote ends of the pockets of the distributor 60'.

Figure 5:
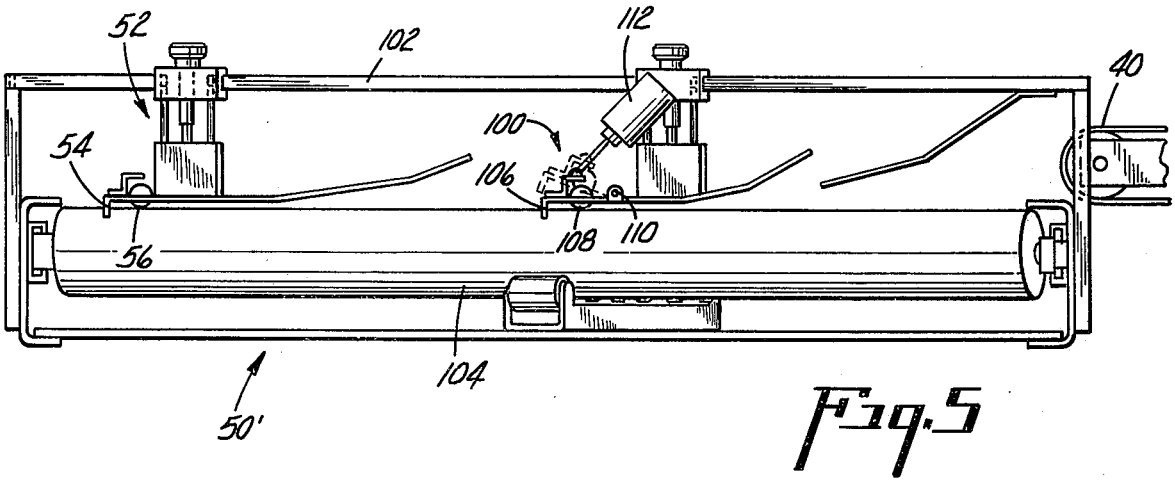
FIG. 5 is an elevation similar to a portion of FIG. 2, illustrating the alternate form of direction changing mechanism.

The sheet guide and aligning means 52 and 100 are shown only diagrammatically in FIG. 4, but in FIG. 5 which is to a larger scale, they are shown in somewhat more detail.

The sheet guide and aligning means 52 and 100 are shown as adjustably supported on overhead tracks 102, only one of which appears in the drawing. The means 52 includes a sheet top and guiding margin 54, and weighted balls 56 for maintaining driving contact between the rollers 104 of the conveyor 50' and a sheet. The means 100 is similarly equipped with a sheet stop and guiding margin 106 and weighted balls 108. In this case, however, the portion carrying the sheet top and guiding margin 106 is mounted on the main support in a hinged manner, as at 110. This permits the sheet stop and guiding margin 106 to be moved to an inactive position (shown in dotted lines) by any suitable mechanism, for example a solenoid 112.

OPERATION

In discussing the operation, reference may be had primarily to FIG. 1 wherein various operator positions are identified by the circled characters A through G inclusive.

When a duplicating work assignment is delivered to the operator, this takes place at desk 76 with the operator at station A to receive the work, sort it, and categorize it for the day's duplicating schedule.

As duplicating commences the operator moves to position B at the input end of the duplicator, where she may either insert originals into the master maker via path 24, or insert prepared masters into a suitable hopper at the input end of the duplicator.

The operator then steps to position C from which she can check the mode and status of the duplicating machine at control panel 30 to make certain that it accords with the conditions required by the current work. The printing operation machine may also be started from this position.

Stepping to position D, the operator selects the position of interface transport 40 using lever 45 and directs copies to the paper receiver 19, FIG. 2, or to the conveyor 50 as the job requires. At position D the operator can readily inspect initial copies to be certain that the equipment is properly adjusted and is printing copies whose quality is according to expectations. The duplicator controls 68 at panel 64 are within easy reach if stopping the operation should be required.

From position E in front of the control panel 64 the operator can readily monitor the duplicating operation, setting the count for the duplicator, either with respect to the present run before starting, or setting the count for a subsequent run after the present printing run has started. Likewise the operating condition of the sheet distributor 60 can be overseen, and under certain circumstances the operator can intervene and control it directly if necessary.

Figure 3:
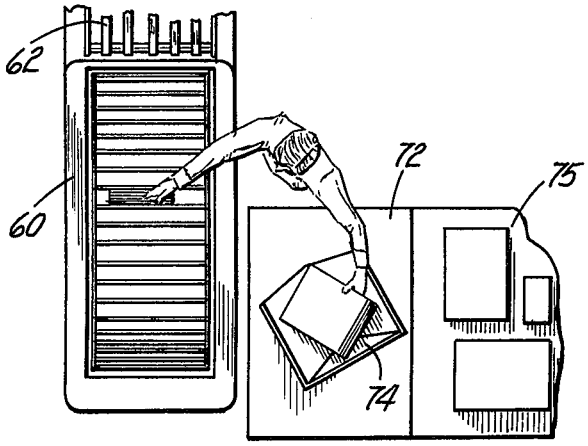
FIG. 3 is a partial plan view illustrating the relationship of the distributor and the jogging mechanism to each other and to an operator unloading the distributor.

From the position F, the operator can control the sheet distributor if necessary, and in particular can set it in a slowly stepping mode so that she can stand at one location and remove a packet of sheets from a pocket, transfer it to the jogger to bring the sheet edges into alignment, and thence to portion 74 of the work surface, and these motions may be made from one position with the utmost convenience as may be appreciated particularly by reference to FIG. 3.

Jogged sheets can be stapled and packaged when the operator moves to station G. and the completed work can be arranged and stacked for pick up.

From the foregoing it can be seen that the duplicating work assignments can be handled by a single operator taking full advantage of the automated character of the equipment and achieving maximum output without undue strain due to the specific arrangements of work devices with respect to each other and their interconnecting transports.

There is, moreover, a further respect in which the operator can take advantage of the equipment capacity. If the operator considers the nature of the work to be done, it is possible to alternate jobs in such a way that jobs of a firstt type requiring treatment at the distributor are alternated with jobs of a second type which involve moderately lenghtly runs requiring merely accumulation of all copy sheets at one point. In this situation the operator can merely introduce a job of the first type, allowing the sheets to accumulate in the distributor pockets. When the duplicator has completed a job of the first type, and during the cycle change, the operator can install a job of the second type. By turning the lever 45 the distributor can be left inactive and the right hand end of the conveyor 41 of the interface transport 40 raised, thereby allowing all sheets of the second job to be fed into the receiver 19. While this is occurring, the operator may set the distributor in a slow stepping mode for unloading and can then complete the first job as previously described while the second job is running simultaneously.

When constructions as shown in FIGS. 4 and 5 are included in the system, the operator can use the equipment with even further enhanced efficiency and flexibility.

For example, the operator may operate the system on a first job requiring sheet distribution or collating by causing the sheets to encounter the sheet stop and guiding margin 106 of the aligning mechanism 100, so that the sheets are directed into track A and thereby reach the near side of the distributor pockets. When this job is completed and resting in the pockets, a second similar job may be started, but with the sheet stop and guiding margin 106 set in disabled position (broken lines in FIG. 5) so that the sheets issuing from the duplicator reach the sheet stop and guide margin 54 and thereby enter track B so as to be deposited in the remote portions of the distributor pockets. This will be effected by activating a suitable button on the control panel 64 controlling the energization of the solenoid 112. Then, while the second job is in progress, the operator may unload the first job from the drum pockets as they move slowly by her position at F.

It will now be apparent, as a result of the above disclosure, that the construction in FIGS. 4 and 5 can be put to highly efficient use in various ways. One such alternate arrangement, for example, would provide for controlling the setting of the stop and guide margin 106 automatically in response to counting of sheets by a sensor at any desired location in the paper path. This would permit collating of a larger number of copies of a book in a single run by putting a sheet in each pocket on track A, automatically shifting to track B, then putting a sheet in each pocket on track B, and repeating this procedure for each new page. In this fashion, a run of book copies which is double the number of pockets in distributor 60' can be collated in a single operation.

Various ways in which the important convenience aspects of the present equipment may be taken advantage of have been described, but alert operators will find the equipment useful and convenient in many different ways so that the scope of the invention is to be understood from the subjoined claims rather than from the few detailed examples herein set forth.

What is claimed is:

1. A duplication system comprising:

duplicating means for preparing copies on copy sheets and forwarding the copies in a series along a linear path to a discharge location;

a direction changing device located adjacent the discharge end of said duplicating means for accepting sheets therefrom and redirecting their motion in a direction substantially normal to the copy sheet path through the duplicator;

a sheet distributor having a feed-in conveyor and sheet receiving pockets arranged to receive the copy sheets approaching the same along said substantially normal direction, said direction changing device and said sheet distributor being of widths to accommodate more than twice the single sheet dimension of the sheets issuing from the duplicating means so as to accommodate two parallel independent sheet tracks; and means associated with the direction changing device for selectively forwarding sheets received from said duplicating means in said substantially normal direction along either of said tracks to distinct portions of the pockets of said sheet distributor.

2. A duplication system as set forth in claim 1 in which the direction changing device comprises a roller conveyor and a pair of parallel sheet stop means cooperating with said roller conveyor, each arranged to establish one of said sheet tracks therealong, and wherein the means for selectively forwarding the sheets comprises means to dispose the sheet stop means nearest the duplicating means either in an intercepting position to guide the sheet into a first track, or into a nonintercepting position to allow a sheet to bypass it and thus be guided into the second track by the sheet stop means more remote from the duplicating means.

3. A duplication system comprising:

elongate duplicating means for preparing copies on copy sheets and forwarding the copy sheets in a series along a linear path to a discharge location, and having an input end and a discharge end, said means being designed to be approachable and operable by an operator from an operation side;

a direction changing device located adjacent the discharge end of said duplicating means for accepting sheets therefrom and redirecting their motion to a path substantially normal to the long dimension of said duplicator; and a sheet distributor comprising a frame having an operation side, a feed-in conveyor and an array of sheet receiving pockets with operator access openings, said pockets being so disposed on said frame as to have the operator access openings made available to a position substantially at trunk level of an operator standing at the operation side of said frame, for ready unloading by an operator, said distributor being positioned at a location in proximity to the operation side of said duplicating means and oriented in a direction to receive copy sheets from said direction changing mechanism along said substantially normal path and with the frame extending from the operation side of the duplicator with its own operation side facing substantially towards the input end of the duplicating means, said direction changing device and said sheet distributor being of widths to accommodate more than twice the single sheet dimension of the sheets issuing from the duplicating means so as to accommodate two parallel independent sheet tracks; and means associated with the direction changing device for selectively forwarding sheets received from said duplicating means in said substantially normal direction along either of said tracks to distinct portions of the pockets of said sheet distributor.

4. A duplication system as set forth in claim 3 in which the direction changing device comprises a roller conveyor and a pair of parallel sheet stop means cooperating with said roller conveyor, each arranged to establish one of said sheet tracks therealong, and wherein the means for selectively forwarding the sheets comprises means to dispose the sheet stop means nearest the duplicating means either in an intercepting position to guide the sheet into a first track, or into a nonintercepting position to allow a sheet to bypass it and thus be guided into the second track by the sheet stop means more remote from the duplicating means.

5. A duplication system comprising:

elongate duplicating means for preparing copies on copy sheets and forwarding the copy sheets in a series along a linear path to a discharge location, and having an input end and a discharge end, said means being designed to be approachable and operable by an operator from an operation side;

a direction changing device located adjacent the discharge end of said duplicating means for accepting sheets therefrom and redirecting their motion to a path substantially normal to the long dimension of said duplicator;

a sheet distributor operable selectively in any one of plural modes including a collating mode and an unloading mode, comprising a frame having an operation side, a feed-in conveyor and a rotary drum comprising sheet receiving pockets with operator access openings, said pockets being progressively movable to a position such that the operator access openings are made sequentially available to a position substantially at average trunk level of an operator standing at the operation side of said frame, for ready unloading by an operator, said distributor being positioned at a location in proximity to the operation side of said duplicating means and oriented in a direction to receive copy sheets from said direction changing mechanism along said substantially normal path and with the frame extending from the operation side of the duplicator with its own operation side facing substantially towards the input end of the duplicating means, said direction changing device and said sheet distributor being of widths to accommodate more than twice the single sheet dimension of the sheets issuing from the duplicating means so as to accommodate two parallel independent sheet tracks;

means associated with the direction changing device for selectively forwarding sheets received from said duplicating means in said substantially normal direction along either of said sheet tracks to distinct portions of the pockets of said sheet distributor;

a control station located on the sheet distributor frame and positioned on the operation side thereof between the discharge location and the sheet distributor, said control station including means for controlling the starting and stopping of the duplicating means and the sheet distributor, means for controlling the copy count for duplication means and means for selecting the mode of operation of the sheet distributor;

work surface means projecting from a point adjacent the operation side of the distributor, parallel to the long dimension of the duplicating means and extending from the distributor towards a position of proximity to the input end of the duplicating means to define with said duplicating means and said distributor a three-sided operator work space enclosure, the portion of the work surface means nearest the input end of the duplicating means being constructed with suitable knee space to provide a desk facility for a sitting operator to receive and arrange incoming work; and a power sheet jogger associated with the work surface means at a location such that it is within ready reach of an operator who is also within reach of the access openings of the sheet distributor.

6. A duplication system comprising:

elongate duplicating means for preparing copies on copy sheets and forwarding the copy sheets in a series along linear path to a discharge location, and having an input end and a discharge end, said means being designed to be approachable and operable by an operator from an operation side;

a direction changing device located adjacent the discharge end of said duplicating means for accepting sheets therefrom and redirecting their motion to a path substantially normal to the long dimension of said duplicator;

a sheet distributor operable selectively in any one of plural modes including a collating mode and an unloading mode, and comprising a frame having an operation side, a feed-in conveyor and a rotary drum comprising sheet receiving pockets with operator access openings, said pockets being progressively movable to a position such that the operator access openings are made sequentially available to a position substantially at average trunk level of an operator standing at the operation side of said frame, for ready unloading by an operator, said distributor being positioned at a location in proximity to the operation side of said duplicating means and oriented in a direction to receive copy sheets from said direction changing mechanism along said substantially normal path and with the frame extending from the operation side of the duplicator with its own operation side facing substantially towards the input end of the duplicating means, said direction changing device and said sheet distributor being of widths to accommodate more than twice the single sheet dimension of the sheets issuing from the duplicating means so as to accommodate two parallel independent sheet tracks;

means associated with the direction changing device for selectively forwarding sheets received from said duplicating means in said substantially normal direction along either of said sheet tracks to distinct portions of the pockets of said sheet distributor;

an interface transport at the discharge end of the duplicating means for conducting copies to said direction changing device by which they are conducted to the distributor in-feed conveyor, a copy receiver for accepting copies directly from the discharge of said duplicating means, and means for selectively directing the copies discharged from said duplicating means either to said interface transport or to said copy receiver, whereby the operator may alternate work assignments to run a duplicating run not requiring distribution while completing the removal of a previous distributed run from the pockets of the distributor;

a control station located on the sheet distributor frame and positioned on the operation side thereof between the discharge location and the sheet distributor, said control station including means for controlling the starting and stopping of the duplicating means and the sheet distributor, means for controlling the copy count for the duplication means and means for selecting the mode of operation of the sheet distributor;

work surface means projecting from a point adjacent the operation side of the distributor, parallel to the long dimension of the duplicating means and extending from the distributor towards a position of proximity to the input end of the duplicating means to define with said duplicating means and said distributor a three-sided operator work space enclosure, the portion of the work surface means nearest the input end of the duplicating means being constructed with suitable knee space to provide a desk facility for a sitting operator to receive and arrange incoming work; and a power sheet jogger associated with the work surface means at a location such that it is within ready reach of an operator who is also within reach of the access openings of the sheet distributor.

7. A duplication system as set forth in claim 6 in which the direction changing device comprises a roller conveyor and a pair of parallel sheet stop means cooperating with said roller conveyor, each arranged to establish one of said sheet tracks therealong, and wherein the means for selectively forwarding the sheets comprises means to dispose the sheet stop means nearest the duplicating means either in an intercepting position to guide the sheet into a first track, or into a non-intercepting position to allow a sheet to bypass it and thus be guided into the second track by the sheet top means more remote from the duplicating means.

* * * * *